US006652390B2

(12) United States Patent
Bradford

(10) Patent No.: US 6,652,390 B2
(45) Date of Patent: Nov. 25, 2003

(54) SPREAD HEEL/TOE WEIGHTED GOLF CLUB

(76) Inventor: Brent W. Bradford, 18102 Flynn Dr. #4601, Canyon Country, CA (US) 91351

( * ) Notice: Subject to any disclaimer, the term of this patent is extended or adjusted under 35 U.S.C. 154(b) by 0 days.

(21) Appl. No.: 09/904,656

(22) Filed: Jul. 16, 2001

(65) Prior Publication Data

US 2003/0013546 A1 Jan. 16, 2003

(51) Int. Cl.[7] ..... A63B 53/04
(52) U.S. Cl. ..... 473/341; 473/340; 473/342
(58) Field of Search ..... 473/340, 334, 473/335, 341, 342, 346, 347, 349, 350

(56) References Cited

U.S. PATENT DOCUMENTS

| | | | | | |
|---|---|---|---|---|---|
| 3,966,210 | A | * | 6/1976 | Rozmus | 473/341 |
| 5,605,510 | A | * | 2/1997 | Schmidt et al. | 473/251 |
| D381,382 | S | | 7/1997 | Fenton, Jr. | D21/217 |
| D399,274 | S | | 10/1998 | Bradford | D21/217 |
| 5,842,935 | A | * | 12/1998 | Nelson | 473/341 |
| 5,951,412 | A | * | 9/1999 | Rose et al. | 473/340 |
| D422,041 | S | | 3/2000 | Bradford | D21/736 |
| 6,238,302 | B1 | * | 5/2001 | Helmstetter et al. | 473/340 |
| 6,273,831 | B1 | * | 8/2001 | Dewanjee | 273/DIG. 8 |

* cited by examiner

*Primary Examiner*—Paul T. Sewell
*Assistant Examiner*—Tom Duong
(74) *Attorney, Agent, or Firm*—Welsh & Flaxman LLC

(57) ABSTRACT

The present invention provides an extreme heel and toe weighted golf putter head wherein the weight is spread along the length of the head and outside of the effective hitting area. The putter includes a head having a front surface shaped and dimensioned for contacting a golf ball and a back surface shaped and dimensioned for placing the weight of the club at a relatively large distance from the striking face. The back surface has a toe wing, a shaft connection, and a heel wing, with the wings angling back beyond and away from the centered shaft connection on either side. More specifically, the putter includes a toe section having a toe wing extending back and away from the striking face toward the toe section of the putter. The heel section having a heel wing extending back and away from the striking face toward the heel section of the putter. A recess formed in the body, the toe wing, and the heel wing and a light weight insert material filling the recess formed in the body, toe wing and heel wing.

15 Claims, 6 Drawing Sheets

SPREAD HEEL/TOE WEIGHTED GOLF CLUB

BACKGROUND OF THE INVENTION

1. Field of the Invention

The invention relates to an extreme heel and toe weighted golf club. More particularly, the invention relates to a putter where material has been removed from the face surface and interior of the club head down along two rearwardly angled wings, to shift the club head weighting off the face and to the extreme heel and toe locations. Therefore, a the majority of the mass of the club head is located at the tips of the putter wings which are located behind and laterally spaced from the striking area of the club head.

2. Description of the Prior Art

Generally, putters fall into two categories of clubs mallet-style and blade-style. The mallet-style putter has a relatively large, solid head that is often semi-circular in shape when viewed from above, while the blade-style putter has a relatively narrow or blade-like head. Each type of putter includes a generally flat strike face for hitting the golf ball and accuracy of the putt depends upon where the strike face impacts the ball, as well as on the orientation of the strike face at impact. Accuracy also depends on hitting the ball at a central area of the strike face, known in the art as the "sweet spot". Generally, control of the direction of travel of the golf ball, and the distance traveled, decreases with the increase in distance away from the sweet spot from which the ball is struck. However, the effective hitting area or sweet spot may be expanded by appropriately weighting the putter head. Weighting may also be used to improve the feel and stability of the putter head during the putting stroke.

The balance, weight, and moment of inertia of a putter plays an important role in the effectiveness of the club. As such Applicant's design goal is to increase the effective striking area while maintaining a high moment of inertia and reduce the effect of torque created from an off-center golf stroke.

The traditional de-weighting process involved removing exterior weight. With this design, the hosel is typically located at the end of the club head. More recently, putter head manufacturers have removed the weight from the interior of the putter head. Once the heavier material is eliminated, a solid insert of lower density material connects to the head and creates a new striking surface.

Many golf putter designs have attempted to maximize the sweet spot provided by a golf club. However, a need continues to exist for a putter head to provide a center of gravity moved rearward from the striking face and extreme heal and toe spread weighting while not reducing the overall feel of the putter. The present invention provides a putter head with the majority of the putter head mass moved to the tips of the "wings". The face surface and interior of the wings are tooled to create voids and reduce weight. An insert material is poured into the voids resulting in extreme heel and toe weighting and a center of gravity far removed from the striking face.

SUMMARY OF THE INVENTION

It is, therefore, an object of the present invention to provide an extreme heel and toe weighted golf putter head wherein the weight is spread along the length of the head and outside of the effective hitting area. The putter includes a head having a front surface shaped and dimensioned for contacting a golf ball and a back surface shaped and dimensioned for placing the weight of the club at a relatively large distance from the striking face. The back surface has a toe wing, a shaft connection, and a heel wing so that a top view is generally appears "W"-shaped, with the wings angling back beyond and away from the centered shaft connection on either side. More specifically, the putter includes a body having a heel section, toe section, upper surface, lower surface and striking face. The toe section having a toe wing extending back and away from the striking face toward the toe section of the putter. The heel section having a heel wing extending back and away from the striking face toward the heel section of the putter. A recess formed in the body, the toe wing, and the heel wing and a shaft connection in the body located between the wings. An insert material filling the recess formed in the body, toe wing and heel wing forming a flat soft feel putter striking face.

It is also an object of the present invention to remove a portion of the heavy interior material from the striking surface and/or interior of the wings to create voids.

It is also an object of the present invention to fill the putter head voids with a lighter weight material, such as an elastomer co-polymer.

It is a further object of the present invention to provide a putter head wherein the creation of spread extreme heel and toe weighting creates a shift in the center of gravity and a greater resistance to club head twisting by creating a larger moment of inertia to torque.

It is also an object of the present invention to create a de-weighted putter head that is more efficient and playable with better balance.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
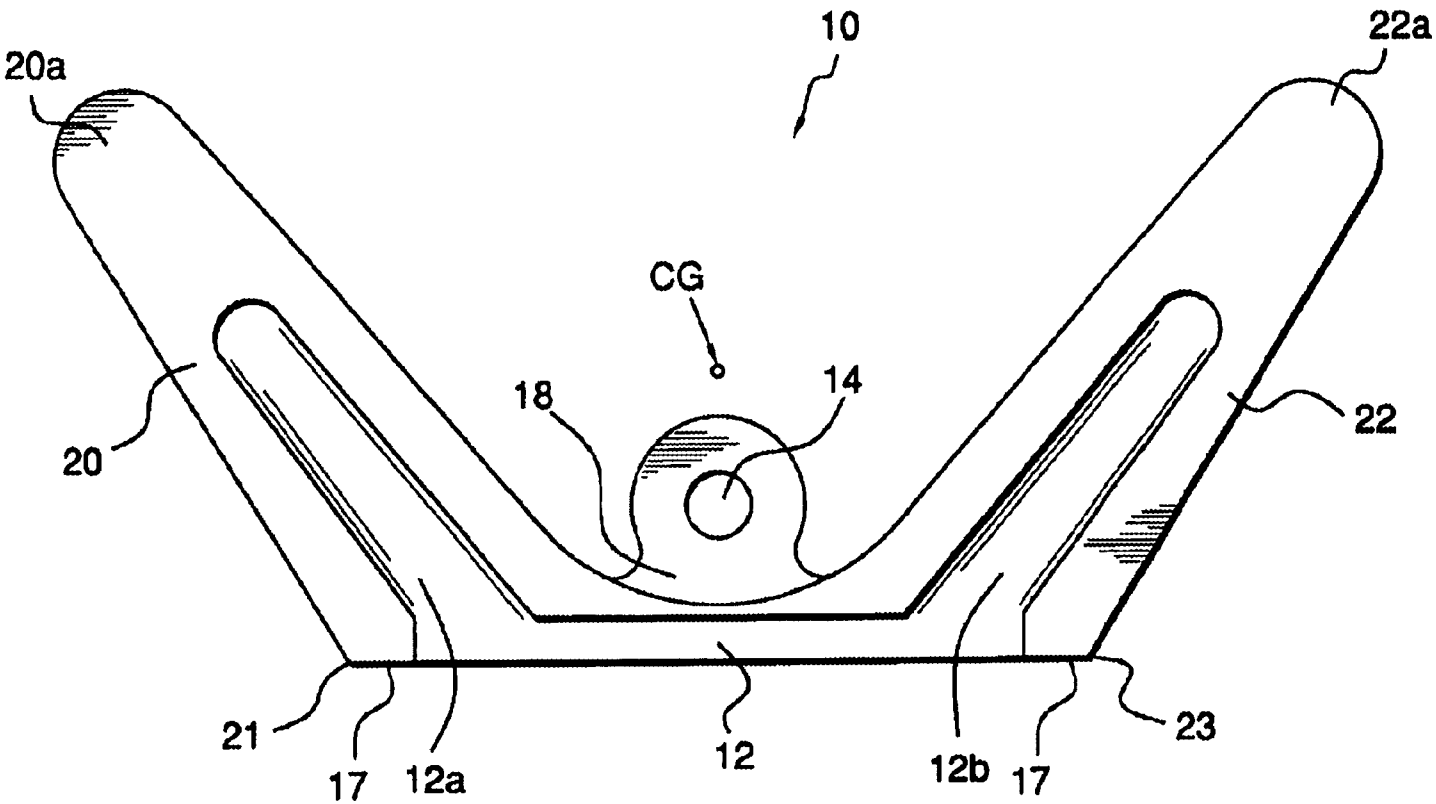
FIG. 1 is a cross-section taken along line a—a in FIG. 2 highlighting the locations where a insert will be located.
Figure 5:
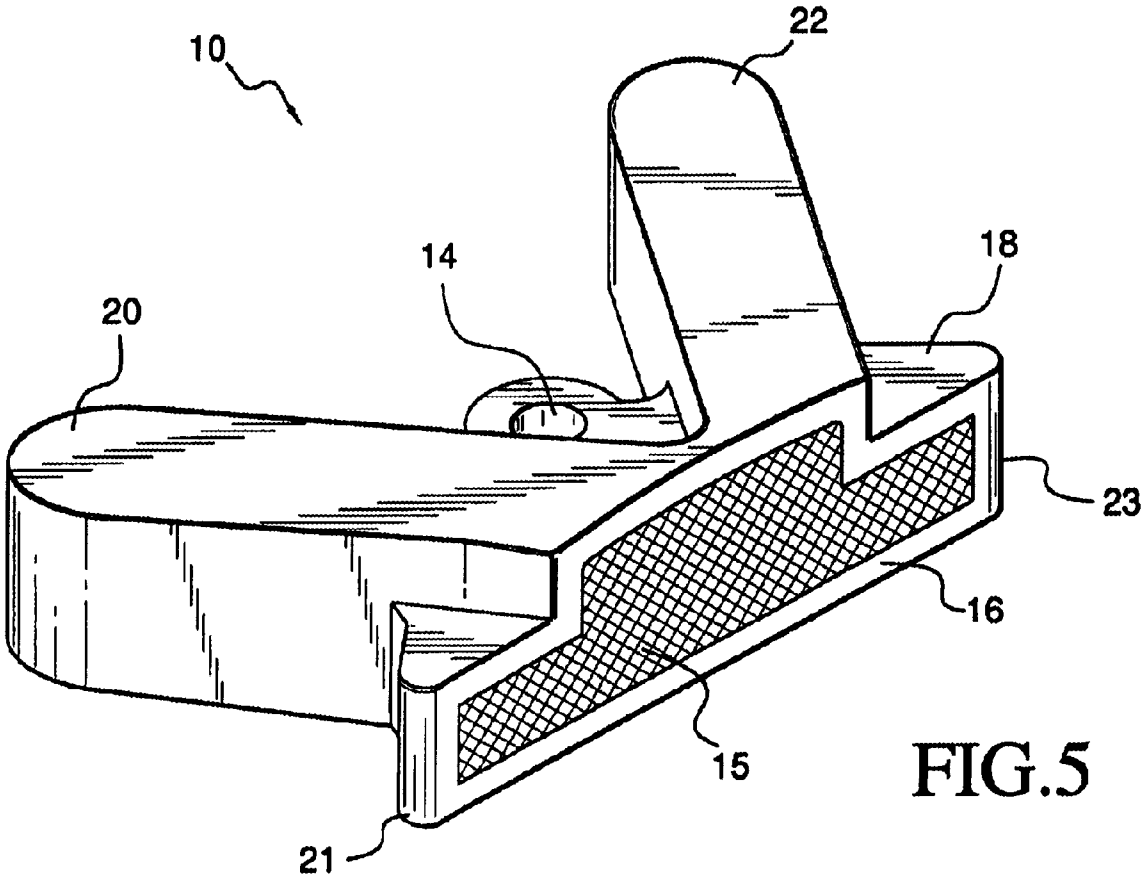
FIG. 5 is a perspective vie of the club head of the preferred embodiment.

With reference to FIGS. 1 and 5, a golf putter head 10 is shown having a body 18 with a recess 12 defined therein.

The golf club head 10 is of a specific "winged" configuration and includes a toe wing 20 and heel wing 22 which extend back from a striking face 16. The wings 20, 22 also extend laterally on an angle from the body 18 beyond the striking face toe edge 21 and striking face heel edge 23. These wings add weight which moves the center of gravity (CG) rearwardly from the striking face 16. The putter head 10 includes a shaft connection 14 for attachment of a golf club shaft thereto.

The recess is 12 shaped to remove a large portion of the interior of the body 18 and a portion of each wing 20, 22. The recess 12 is preferably filled with a pour-in insert 15 of a lighter weight material so as to be planar with the metal club face 17 to form a flat soft to the touch striking face 16.

The insert 15 is preferably a non-metallic material but could be any light weight material including various light weight metals. However, the preferred material is an elastomeric material, such as a polyurethane.

The putter head 10 may be made from any material commonly used in the manufacture of putter heads. For example, the putter head may be a metal, or an alloy of various metals. The preferred material is brass.

Figure 2:
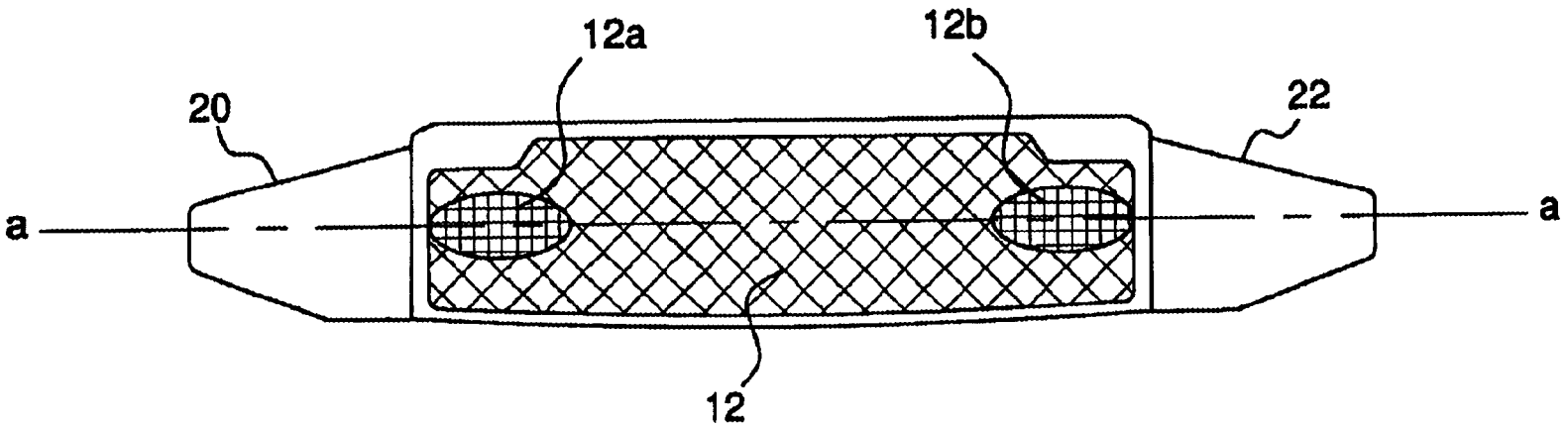
FIGS. 2 is a face view, facing the striking surface, highlighting the locations where heavy material will be removed, including cavities running down the wings.

FIG. 2 is a face view further illustrating the amount of material removed to create the recess 12 in the striking face 16. Voids 12*a* and 12*b* continuous with recess 12 are created in the interior of the wings 20,22 but do not extend the whole length of the wings 20,22. Thus the mass at the tip sections is much greater than the rest of the wings since the voids will be filled with a much lighter insert 15. Thus the solid metal wing tips weigh more than the striking face portion of the club head. The continuous recess also provides another extremely beneficial feature in that it functions to aid in securing the insert 15 to the club body. Due to the angle of the wings and recess formed therein, insert 15 includes angled legs extending down the wings 20, 22 which prevented it from easily being removed.

Figure 3:
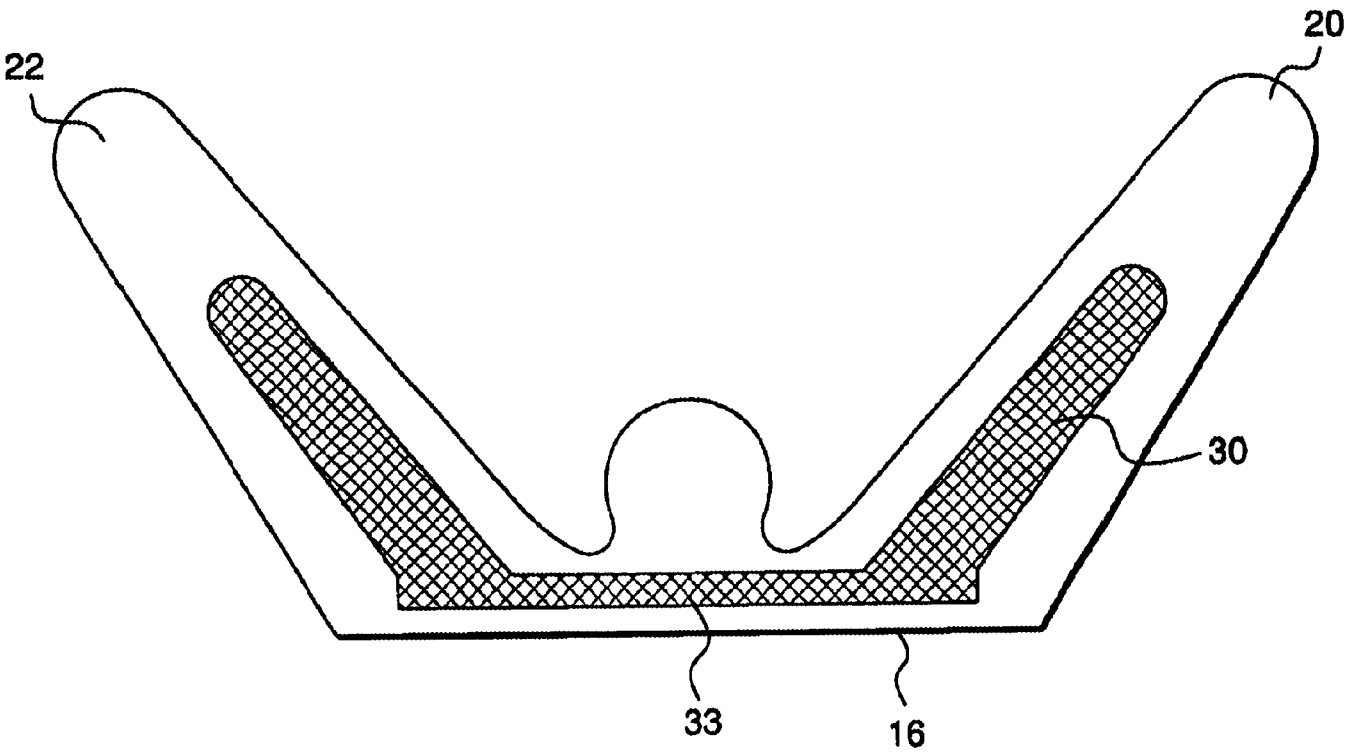
FIGS. 3 and 4 are sole views illustrating embodiments wherein the striking surface is left intact and the insert material is added through the putter head sole.
Figure 4:
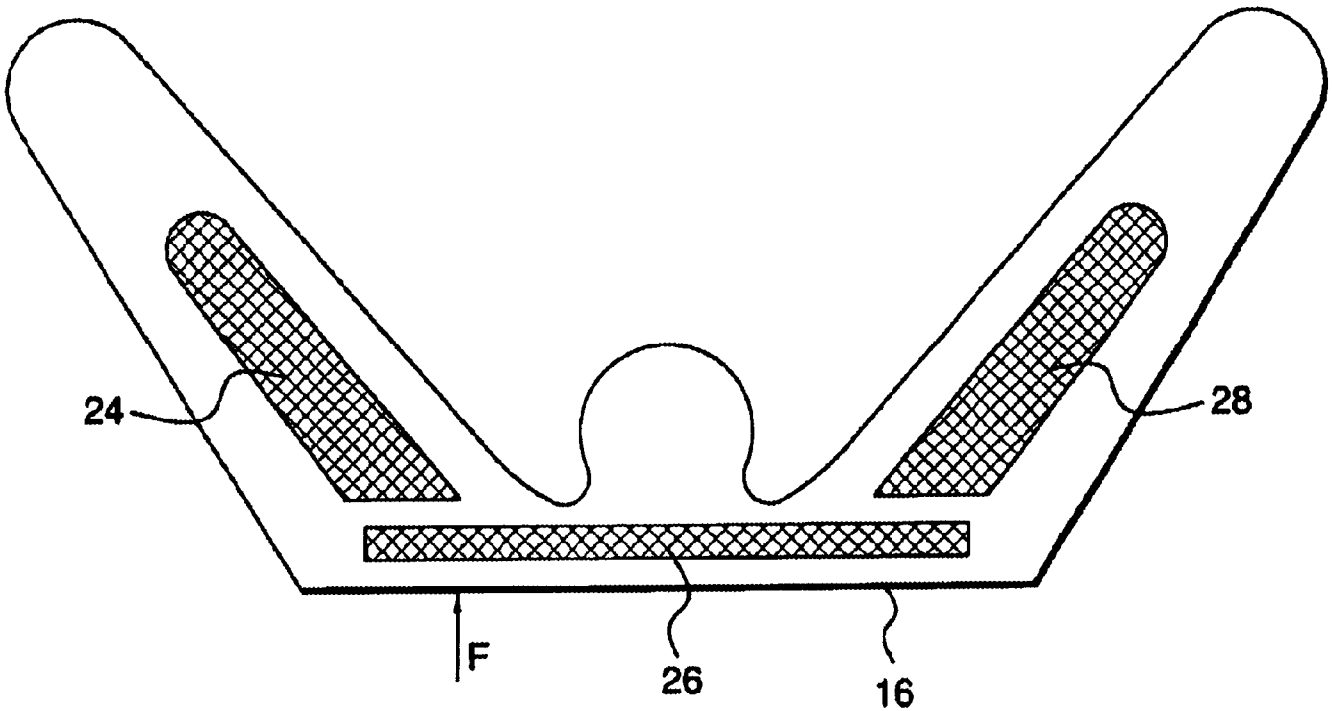

FIGS. 3 and 4 are sole views of an additional embodiment wherein the striking face 16 is left intact and the recess is formed from the sole upward. In FIG. 3 a recess 30 forms a continuous void extending down both wings 20, 22 and is connected by a channel 33 behind the striking face 16. The material is removed directly through the sole.

In FIG. 4, the putter head is formed with three separate voids 24, 26, 28. The striking face 16 is left intact and the insert material is poured into each void through the sole.

Figure 6:
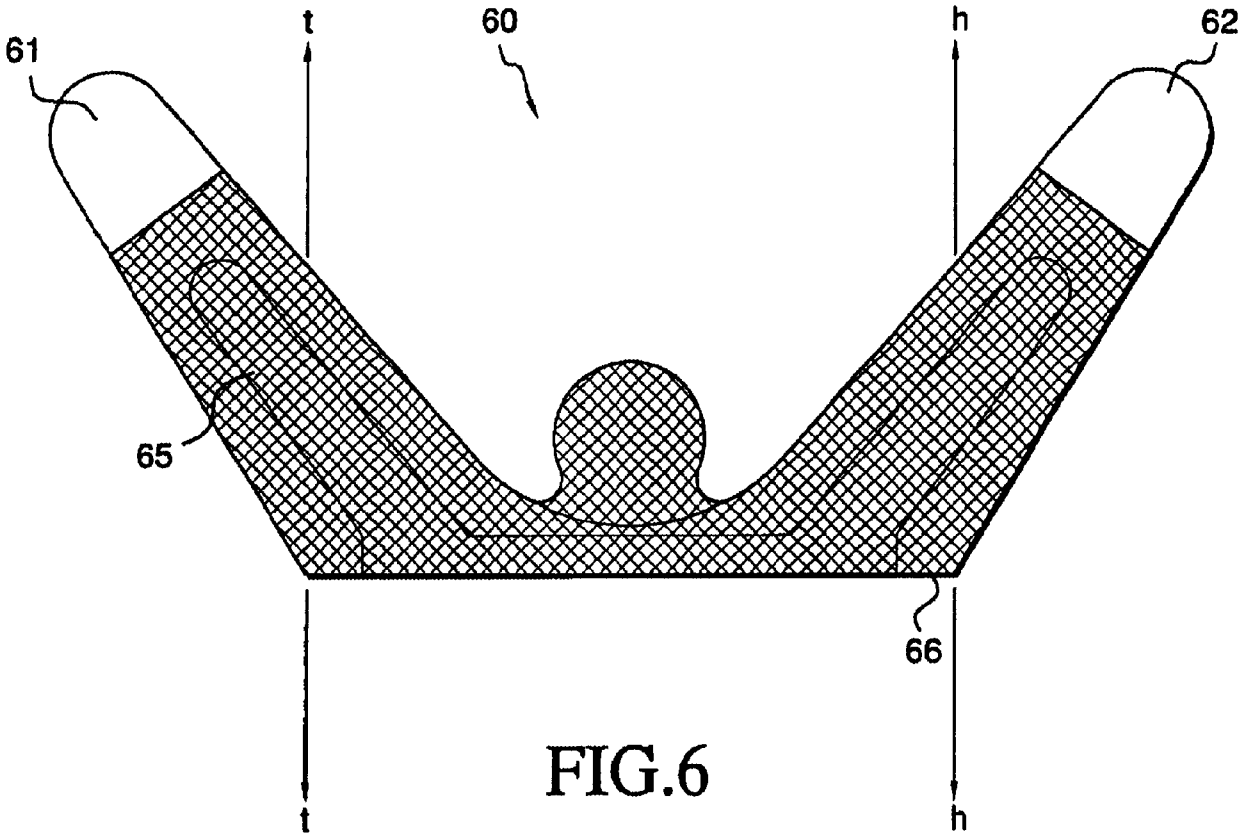
FIG. 6 is a top view of another embodiment wherein the extreme the extreme wing tips are made from a heavier material.

In FIG. 6, a putter head made from two different materials is shown. The body 65 from a lighter material such as aluminum and the wing tips 61, 62 from a heavier material such as tungsten. This embodiment also results in spread heel/toe weighting with at least twenty-five percent of the club head weight being located outside the effective hitting area bound by lines t—t and h—h. These lines are at the edge of the striking face toe and heel, respectively. Again, by spreading the weight outside of the effective hitting area the sweet spot of the club face is increased. That is off-center contact will not cause club head twisting, because the force need to create a moment about the center of gravity is greater than that caused by off-center ball contact. The spreading of the weight aids in resisting any torque caused by an off-center contact force. The movement of the weight rearward from the striking face also moves the center of gravity back as discussed above which also functions to aid in preventing club head twist in cooperation with the spread heal/toe weighting.

In general, the specific weighting of the putter head 10 is designed to provide an extreme heel and toe weighting. For example, the wings 20, 22 allow the mass to be moved much further back and beyond the striking face. Thus, the center of gravity can be moved much further back than the typical "blade" or "mallet" putter. Further, removing the interior mass of the wings, except for at the tips, increases this attribute significantly in comparison to other designs.

Not only does this design provide for extreme heel and toe weighting, but it locates large masses 20*a*, 22*a* outside the striking face edges 21 and 23 and on opposite sides of shaft connection 14. This type of weight resembles a barbell. With this design a higher moment of inertia for club head twisting is created, reducing the effects of torque from an off-center putt. Thus the force F, shown in FIG. 4, of a ball struck at off-center point will be minimal compared to the force required start the head twisting. That is, the force generated by striking a ball is minimal when compared to the weight displaced from the central striking surface as a result of the weighted wings which shift the weight of the putter head toward the heel and toe of the club. These weighted wings generate a substantial moment which compensates, and covers up, any undesirable moments generated when a golf ball is struck off center by an individual putting.

It will certainly be understood by those of ordinary skill in the art that the dimensions of the putter head 10 may be varied depending upon the particular swing characteristics desired for the putter head 10. For example, with reference to FIG. 1, and in accordance with the preferred embodiment of the present invention, the wings 20, 22 may extend back and away from the center of gravity at various angles.

The improved accuracy is a result of the total head design features. The weight of the metal material exceeds the insert material so that a majority of the weight resides in the tips of the wings 20, 22. The total head design features and the mass positioning produce a straighter, more reliable putt. When a ball is not struck squarely, the club will tend to 'twist' and the ball will generally not travel in a straight path. The club of the present invention has a higher moment of inertia in the torque or twist plane of the club head helping to direct improperly struck golf balls toward a desired path. The heel and toe weighting creates a higher moment of inertia, reducing the effects of torque from an off-center putt. This directly effects the accuracy of the shot and is better for performance.

Despite the recess 12 created for the insert, the putter head 10 provides excellent balance permitting balls to be struck consistently, even off-center. In fact, by altering the weight distribution, head configuration and insert material, the center of gravity and the total mass within the golf club head can be ideally defined.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A putter type golf club head including a body having a heel section, toe section, upper surface, lower surface and striking face terminating with toe and heel edges, further comprising:

a toe wing extending back and away from said striking face toward the toe section of said head, wherein the wing extends laterally beyond the striking face toe edge;

a heel wing extending back and away from said striking face toward the heel section of said head, wherein the wing extends laterally beyond the striking face heel edge;

a recess formed in the body, the toe wing, and the heel wing and extending from said body into a portion of each wing beyond the extent of the edges of the striking face, wherein the recess reduces the weight of the body and a portion of each wing; and a shaft connection located between said wings.

2. A golf putter head according to claim 1, wherein an insert material fills the entire recess and is planar with the striking face.

3. A golf putter head according to claim 1, wherein an insert material fills the entire recess and is located behind the striking face of said head.

4. A golf putter head according to claim 1, wherein the recess is filled with a light weight insert material.

5. A golf putter head according to claim 1, wherein the wings are weighted beyond the extent of the edges of the striking face, thereby spreading the putter head weight.

6. A golf putter head according to claim 5, wherein the weight of the wings extending laterally beyond the extent of the edges of the striking face is greater than the weight of the body.

7. A golf putter head according to claim 2, wherein the insert is one continuous piece of poured elastomeric material.

8. A golf putter head according to claim 3, wherein the insert is inserted into the head through the lower surface.

9. A putter type golf club head including a body having a heel section, toe section, upper surface, lower surface and striking face terminating with toe and heel lateral edges, further comprising:

a toe wing extending back and away from said striking face toward the toe section of said head, wherein the wing extends laterally beyond the striking face toe lateral edge;

a heel wing extending back and away from said striking face toward the heel section of said head, wherein the wing extends laterally beyond the striking face heel lateral edge;

a shaft connection located between said wings;

spread weighting of the head such that greater than twenty-five percent of the total head weight extends beyond the lateral edges of the striking face; and wherein a first portion of the toe and heel wings approximate the tips thereof are made from a first material and the remainder of the wings are made from a second lighter material.

10. A golf putter head according to claim 9, wherein the first material is tungsten.

11. A golf putter head according to claim 9, wherein the second lighter material is aluminum.

12. A golf putter head according to claim 10, wherein the second lighter material is aluminum.

13. A putter type golf club head including a body having a heel section, toe section, upper surface, lower surface and striking face terminating with toe and heel lateral edges, further comprising:

a toe wing extending back and away from said striking face toward the toe section of said head, wherein the wing extends laterally beyond the striking face toe lateral edge and is made from a first material;

a heel wing extending back and away from said striking face toward the heel section of said head, wherein the wing extends laterally beyond the striking face heel lateral edge and is made from a first material;

a shaft connection located between said wings; and wherein the remainder of the putter head is made from a second material lighter than said first material and weighting of the head is spread such that a greater portion of the total head weight extends beyond the lateral edges of the striking face.

14. A golf putter head according to claim 13, wherein the first material is tungsten.

15. A golf putter head according to claim 13, wherein the second lighter material is aluminum.

* * * * *